United States Patent [19]

Itoi et al.

[11] Patent Number: 4,608,150

[45] Date of Patent: Aug. 26, 1986

[54] PITCH MATERIAL FOR CARBONACEOUS BODY AND A METHOD FOR THE PREPARATION THEREOF

[75] Inventors: Masaaki Itoi; Masakatsu Ohta; Taizo Sugioka; Kunio Yoshihara, all of Sodegaura; Hiroshi Nishitani, Kisarazu, all of Japan

[73] Assignee: Idemitsu Kosan Company Limited, Tokyo, Japan

[21] Appl. No.: 710,021

[22] Filed: Mar. 11, 1985

[30] Foreign Application Priority Data

Mar. 26, 1984 [JP] Japan ..... 59-56211

[51] Int. Cl.[4] ..... C10C 1/00; C10C 3/00

[52] U.S. Cl. ..... 208/22; 208/39; 208/41; 208/44

[58] Field of Search ..... 208/22, 39, 41, 44

[56] References Cited

U.S. PATENT DOCUMENTS

| | | | |
|---|---|---|---|
| 1,404,435 | 1/1922 | Gevers-Orban | 208/41 |
| 1,742,933 | 1/1930 | Pew, Jr. et al. | 208/360 |
| 1,794,542 | 3/1931 | Piron | 208/360 |
| 2,063,860 | 12/1938 | Wait | 208/360 |
| 2,076,498 | 4/1937 | Farwell | 208/360 |
| 2,095,470 | 10/1937 | Foley | 208/360 |
| 2,763,602 | 9/1956 | Cole et al. | 208/41 |
| 2,796,388 | 6/1957 | Beuther et al. | 208/41 |
| 3,692,663 | 9/1972 | Kyoto et al. | 208/44 |
| 4,026,788 | 5/1977 | McHenry | 208/41 |
| 4,209,500 | 6/1980 | Chwastiak | 208/44 |
| 4,303,631 | 12/1981 | Lewis et al. | 208/44 |
| 4,469,667 | 9/1984 | Uemura et al. | 208/22 |
| 4,470,960 | 9/1984 | Uemura et al. | 208/22 |

FOREIGN PATENT DOCUMENTS

| | | | |
|---|---|---|---|
| 2124246 | 2/1982 | United Kingdom | 208/39 |

*Primary Examiner*—Andrew H. Metz
*Assistant Examiner*—Helane Myers
*Attorney, Agent, or Firm*—Frishauf, Holtz, Goodman & Woodward

[57] ABSTRACT

The invention provides a novel pitch material useful as a base material of carbon fibers having excellent mechanical properties and characterized by a unique combination of several property parameters including the content of the optically anisotropic phase of at least 80%, a content of the pyridine-insoluble matter in the range from 30 to 70% by weight, a number average molecular weight in the range from 1000 to 1400 and a softening point in the range from 330° to 380° C. Such a pitch material is obtained from a starting pitch of a petroleum-based residual oil freed from light oily matter through a two-step heat treatment, of which the first step is performed at 400° to 460° C. under a pressure of 5 to 50 mmHg and the second step is performed at 450° to 550° C. for 0.2 to 30 minutes under a pressure of 0.1 to 5 mmHg. The advantages obtained by use of a film evaporator in the above mentioned heat treatment are described. The time taken for the infusibilization treatment of the pitch filaments is greatly decreased when the filaments were prepared from the inventive pitch material by spinning in comparison with conventional pitches and the spinning temperature can also be relatively low.

8 Claims, No Drawings

PITCH MATERIAL FOR CARBONACEOUS BODY AND A METHOD FOR THE PREPARATION THEREOF

BACKGROUND OF THE INVENTION

The present invention relates to a novel pitch material having specific characteristics and useful for the manufacture of a carbonaceous body or, in particular, carbon fiber as well as a method for the preparation of such a pitch material.

In the prior art, carbon fibers are mostly manufactured by the calcination of fibrous bodies obtained by spinning polyacrylonitrile. This process is, however, disadvantageous due to the expensiveness of the starting polymer and the low carbonization yield in the calcination. Therefore, many attempts and proposals have been made recently for the manufacture of carbon fibers from pitch materials of petroleum origin or coal tar origin as the starting material.

Among these prior art methods for the manufacture of pitch-based carbon fibers, for example, a method is proposed in Japanese Patent Kokai Koho Nos. 58-18421, 58-115120, 58-142976, 58-154792 and others according to which spinning of the starting pitch is performed at a temperature higher than the softening point of the pitch by 60° to 130° C. A problem encountered in the spinning process at such a relatively high spinning temperature is the thermal decomposition of the pitch and foaming of the molten pitch so that the process requires a starting pitch material having a softening point as low as possible. A pitch material having a low softening point should have characteristics that the content of the pyridine- or quinoline-soluble matter therein is low and the molecular weight thereof should be relatively small with a broad molecular weight distribution. The carbon fiber-manufacturing process using such a pitch material is, however, disadvantageous because a lengthy time is taken for the infusibilization treatment following spinning of the pitch material.

SUMMARY OF THE INVENTION

It is therefore an object of the present invention to provide a pitch material for carbonaceous bodies having excellent spinnability and capable of giving a carbon fiber having a high mechanical strength even by a remarkably reduced time for the infusibilization treatment of the pitch filament without the problems and disadvantages in the prior art pitch materials as a starting material of carbon fibers.

Another object of the invention is accordingly to provide a method for the preparation of the pitch material mentioned above.

Thus, the pitch material provided by the invention is characterized by the parameters including the content of the optically anisotropic phase of at least 80% by weight, the content of the pyridine-insoluble matter in the range from 30 to 70% by weight, the number average molecular weight in the range from 1000 to 1400 and the softening point in the range from 330° to 380° C.

The method of the invention for the preparation of the above defined novel pitch material comprises the steps of: (a) a first heat treatment of a starting pitch material having been freed from the soft oily matter of a petroleum-based residual oil at a temperature in the range from 400° to 460° C. under a reduced pressure in the range from 5 to 50 mmHg; and (b) a second heat treatment of the pitch material after the step (a) at a temperature in the range from 450° to 500° C. for a length of time in the range from 0.2 to 30 minutes under a pressure in the range from 0.1 to 5 mmHg. Preferably, the heat treatment above mentioned is performed in a film evaporator in an atmosphere of an inert gas or a non-oxidizing gas.

DETAILED DESCRIPTION OF THE PREFERRED EMBODIMENTS

As is mentioned above, the heat treatment of the inventive method in the first step and/or the second step is performed preferably in a film evaporator, the effectiveness of which has been discovered as a result of the extensive investigations undertaken by the inventors. Namely, the use of a conventional reaction vessel equipped with a stirrer has disadvantages that the staying time of the treated material in the reaction zone has a broad distribution function and an undesirable phenomenon of coking is sometimes induced due to the low volume efficiency. The use of a tubular reactor, on the other hand, is disadvantageous due to the inhomogeneity of the reaction product as a result of the large temperature distribution and concentration distribution in the radial direction of the reactor. After further continued investigations on the type of a reaction apparatus, the inventors have discovered that the above mentioned problems and disadvantages are dissolved when the heat treatment is performed in a film evaporator.

As is described above, the pitch material of the invention is characterized by several parameters including the content of the optically anisotropic phase or mesophase, content of the pyridine-insoluble matter, number average molecular weight and softening point each in the range specified above. Specifically, the content of the mesophase in the inventive pitch material for carbonaceous bodies should be in the range from 80 to 100% or, preferably, should be as close as possible to 100%. When the content of the mesophase is smaller than 80%, the miscibility between the mesophase and the isotropic phase is poor so that difficulties are encountered in the spinning of the pitch material to form filaments and the carbon fibers prepared therefrom may have disadvantageously low mechanical strengths.

The content of the pyridine-insoluble matter in the inventive pitch material for carbonaceous bodies should be in the range from 30 to 70% by weight or, preferably, from 40 to 60% by weight. When the content of the pyridine-insoluble matter is smaller than 30% by weight, the softening point of the pitch material may be unduly low so that the infusibilization treatment of the pitch filament takes an excessively long time. When the content of the pyridine-insoluble matter is larger than 70% by weight, on the other hand, the pitch material may have a disadvantageously poor spinnability.

Further, the number average molecular weight of the inventive pitch material should be in the range from 1000 to 1400 or, preferably, from 1000 to 1300. When the number average molecular weight of the pitch material is smaller than 1000, the softening point of the pitch material may be too low so that the infusibilization treatment of the pitch filament takes an excessively long time. When the value is larger than 1400, on the other hand, the pitch material may have a disadvantageously poor spinnability.

Still further, the softening point of the inventive pitch material should be in the range from 330° to 380° C. or, preferably, from 330° to 370° C. When the pitch filament is obtained by spinning a pitch material having a softening point lower than 330° C., the infusibilization treatment thereof may take an excessively long time while a pitch material having a softening point higher than 380° C. may have a disadvantageously poor spinnability.

In the inventive pitch material, all of the above mentioned parameters should have the values each within the above specified range. Even when only one of the parameters does not satisfy this condition, the pitch material is not suitable as a starting material of carbon fibers due to the poor spinnability of the pitch material or an unduly long time taken for the infusibilization treatment of the pitch filament.

The softening point of the inventive pitch material for carbonaceous materials is relatively high as a consequence of the relatively large number average molecular weight in the range of 1000 to 1400 but the pitch material is spinnable at a temperature higher than the softening point by 10° to 60° C. Therefore, pitch filaments can be obtained without the danger of coking or thermal decomposition and, in addition, the infusibilization treatment thereof can be complete within a relatively short time.

The spinnability of the inventive pitch material into pitch filaments is excellent because the spinning can be performed at a temperature not excessively high in comparison with the softening point of the pitch or, in other words, at a temperature sufficiently lower than the decomposition temperature of the pitch material. In addition, the infusibilization treatment of the pitch filaments obtained by spinning of the inventive pitch material is complete within a remarkably shortened time in comparison with the those prepared from conventional pitch materials.

Several methods are applicable to the preparation of the inventive pitch material described above. It is preferable, however, to prepare the pitch material by the method described below in particular, which constitutes a part of the present invention.

Thus, the method of the present invention for the manufacture of the pitch material characterized by the specific values of the parameters including the content of the optically anisotropic phase, content of the pyridine-insoluble matter, number average molecular weight and softening point comprises the steps of: (a) a first heat treatment of a starting pitch material having been freed from the light oily matter of a petroleum-based residual oil at a temperature in the range from 400° to 460° C. under a reduced pressure in the range from 5 to 50 mmHg; and (b) a second heat treatment of the pitch material after the step (a) at a temperature in the range from 450° to 500° C. for a length of time in the range from 0.2 to 30 minutes under a pressure in the range from 0.1 to 5 mmHg.

The starting oil used in the inventive method is a petroleum-based residual oil and preferable petroleum-based residual oil should be selected from those having a high content of aromatic hydrocarbons such as the residual oils from the catalytic cracking of petroleum fractions, residual oils from thermal cracking of naphtha and the like and others.

In the method of the present invention, such a petroleum-based residual oil is subjected in advance to distillation under reduced pressure and the residual oil left by the removal of the light oily matter having a boiling point of about 400° C. or below is used as the starting pitch material. It is preferable that the distillation under reduced pressure is preceded by the removal of the ash in the petroleum-based residual oil by filtration or other suitable method.

In the next place, the above described starting pitch is subjected to the first step heat treatment which is performed under the conditions of a temperature in the range from 400° to 460° C. or, preferably, from 410° to 450° C. and a pressure in the range from 5 to 50 mmHg or, preferably, from 10 to 50 mmHg. The length of time for the heat treatment is usually in the range from 0.1 to 20 hours or, preferably, from 0.2 to 10 hours. When the temperature in this first step heat treatment is lower than 400° C., the reaction velocity is unduly low so that the heat treatment must be performed prolongedly while, when the temperature exceeds 460° C., an increased amount of volatile materials is removed by vaporization with consequent decrease in the yield of the product and an undesirable phenomenon of coking may sometimes take place. When the pressure in the first step heat treatment is lower than 5 mmHg, the yield of the product is also decreased as a result of the increase in the amount of the volatile materials lost by vaporization while, when the pressure is higher than 50 mmHg, the molecular weight distribution of the product is broadened as a result of the insufficient removal of the light fractions.

At any rate, the thus obtained isotropic pitch is subjected to the second step heat treatment in which the treatment conditions for the isotropic pitch containing no or a very small amount of the mesophase pitch are severer than in the first step heat treatment. The heat treatment is performed usually for a length of time in the range from 0.2 to 30 minutes at a temperature in the range from 450° to 500° C. or, preferably, from 460° to 500° C. under a pressure in the range from 0.1 to 5 mmHg or, preferably, from 0.5 to 3 mmHg. When the temperature in this second step heat treatment is lower than 450° C., removal of the lighter matter proceeds less efficiently so that the length of time for the heat treatment must be extended while a temperature of the heat treatment higher than 500° C. is undesirable because of the decrease in the yield and the phenomenon of coking taking place as well as the difficulty in the control of the reaction velocity. When the second step heat treatment is performed under a pressure lower than 0.1 mmHg, the yield of the product pitch is decreased and an elaborate or large-scale vacuum equipment is required while a pressure higher than 5 mmHg is undesirable, on the other hand, due to the insufficient removal of the lighter matter with a consequently broadened molecular weight distribution. When increase of the softening point of the pitch product is desired in this second step heat treatment, the effective means therefor is to decrease the pressure or to extend the length of time for the treat- ment.

In the inventive method for manufacturing a pitch material for carbonaceous bodies, the efficiency of the method can be further increased by performing the second step heat treatment or both of the first and the second heat treatments of the starting pitch in a film evaporator in an atmosphere of an inert gas or a non-oxidizing gas. The film evaporator here implied may be any of the various types of apparatuses used in the conventional vaporization treatment with no particular limitations. For example, the apparatus may be of a vertical or a horizontal type or may be of a type in which scraper blades rotate in contact with the vessel walls. Centrifugal film evaporators are particularly suitable for the purpose. Film evaporators are effective in accelerating the evaporation and dissipation of the volatile matter from the surface of the liquid film which is under continuous refreshment by the rotating scraper blades. The number of the rotating scraper blades is usually from 2 to 16 and the velocity of revolution is usually about 10 to 500 r.p.m. although it should be determined in consideration of various factors.

When a film evaporator is used in the heat treatment of the starting pitch material in the first step treatment or the pitch after the first step treatment in the second step treatment, it is preferable that the heat treatment is performed in an atmosphere of an inert gas or a non-oxidizing gas in order to prevent degradation of the pitch product by oxidation. The inert gas here implied includes neon, helium, argon, nitrogen and the like while methane, ethane and the like are named as the non-oxidizing gas.

Although the thickness of the liquid film in the film evaporator is controllable by adjusting the clearance between the vessel wall and the periphery of the rotating blades, it is usually preferable to keep the thickness in the range up to 10 mm or, more preferably, from 0.5 to 5 mm from the standpoint of obtaining a high efficiency. When no clearance is held between the vessel wall and the periphery of the rotating blades, the liquid film on the vessel wall is completely scraped off by each of the rotating blades in contact with the vessel walls under the centrifugal force or by use of springs. The staying time of the pitch material under the treatment in the film evaporator is controllable by suitably selecting the conditions such as the thickness of the liquid film, form of the rotating blades and velocity of revolution of the blades and should be in the range from 0.1 to 60 minutes depending on the nature of the starting pitch material and the conditions of the reaction.

The above described method of the present invention is effective in manufacturing a pitch material for carbonaceous bodies characterized by the content of the optically anisotropic phase of at least 80%, the content of the pyridine-insoluble matter in the range from 30 to 70% by weight, the number average molecular weight in the range from 1000 to 1400 and the softening point in the range from 330° to 380° C.

The pitch material obtained in this manner can be processed into pitch-based carbon fibers according to a conventional process including the steps of spinning of the pitch into pitch filaments and infusibilization treatment thereof followed by calcination.

Preferable conditions in each of these steps are subject to a wide variation depending on various factors. For example, the infusibilization treatment of the pitch filaments is performed by heating the pitch filament preferably in an oxygen-containing atmosphere to such an extent that the oxygen content in the infusibilized pitch filaments is in the range from 5 to 12% by weight and this infusibilization treatment is followed by the calcination treatment in an atmosphere of an inert gas at a temperature of 1000° C. or higher. The pitch filaments, which may have a diameter of 5 to 15 μm, are obtained by spinning the inventive pitch material at a temperature in the range from 340° to 430° C. or, preferably, from 340° to 400° C. at a spinning velocity in the range from 50 to 2000 meters/minute or, preferably, from 100 to 1000 meters/minute.

To describe in more detail, the infusibilization treatment of the pitch filaments is performed usually in an oxygen-containing atmosphere or, preferably, in atmospheric air with a rate of temperature elevation of 5° to 100° C. per minute in the temperature range from 150° to 250° C. to 350° to 450° C. More preferably, the temperature is increased at a rate of 5° to 40° C. per minute in the range from 150° to 250° C. to 270° to 300° C. and then at a rate of 20° to 100° C. per minute up to the maximum temperature of 350° to 450° C. An excessively large rate of temperature elevation of 40° C. per minute or larger at a relatively low temperature of 270° to 300° C. or below may cause a danger of melt-adhesion of the pitch filaments while the rate of temperature elevation can be increased when the temperature has exceeded 270° to 300° C. due to the disappearance of the danger of melt-adhesion by virtue of the already infusibilized surface layer of the pitch filaments in order to reduce the overall time for the infusibilization treatment by accelerating the infusibilization with an increased diffusion velocity of oxygen into the filaments. The calcination treatment to follow is performed at a temperature of 1000° C. or higher in an atmosphere of an inert gas such as nitrogen, argon and the like. A preferable temperature for the calcination treatment is in the range from 1000° to 1500° C. when carbonization is desired and from 2000° to 2500° C. when graphitization is desired.

Despite the relatively high softening point as a consequence of the narrow distribution of the molecular weight, the inventive pitch material for carbonaceous bodies has a very good spinnability and, differently from conventional pitch materials for carbon fibers, can be spun into pitch filaments at a temperature higher than the softening point only by 10° to 60° C. without the danger of undesirable coking or thermal decomposition. The relatively high softening point of the pitch provides an additional advantage that the infusibilization treatment of the pitch filaments can be complete within a greatly decreased length of time in comparison with conventional pitch materials. Furthermore, the carbon fiber product prepared from the inventive pitch material for carbonaceous bodies is of a very excellent quality with high mechanical properties such as tensile strength. Therefore, the pitch material of the present invention is useful as a base material in the manufacture of various kinds of carbonaceous products including not only carbon fibers but also films, filaments, yarns and the like carbon materials.

In the following, the present invention is described in more detail by way of examples.

EXAMPLE 1

A residual oil of catalytic cracking obtained in a catalytic cracking plant of heavy gas oil was freed from the ash content by filtration and then subjected to distillation under reduced pressure to remove the lighter oily matter and to leave a residual oil having a boiling point of 430° C. or higher under normal pressure as extrapolated from the actually determined value, which was used as the starting material in the subsequent treatments according to the inventive method. This starting pitch material is first subjected to the first step heat treatment at a temperature of 420° C. for 30 minutes under a pressure of 10 mmHg to give an isotropic pitch containing about 40% by weight of a toluene-insoluble matter (specified in JIS K-2425). Subsequently, this isotropic pitch was subjected to the second step heat treatment at a temperature of 460° C. for 20 minutes under a pressure of 1 mmHg to give a finished pitch material composed substantially of the optically anisotropic phase alone. The thus obtained pitch had a number average molecular weight of 1130, content of the pyridine-insoluble matter of 63.3% by weight and softening point of 345° C.

This pitch material was subjected to spinning at a spinning temperature of 368° C. at a spinning velocity of 500 meters/minute to give pitch filaments having a diameter of 7 μm followed by the infusibilization treatment at a rate of temperature elevation of 20° C./minute from 200° to 400° C. taking 10 minutes. Thereafter, the infusibilized pitch filaments were calcined at 1500° C. for 10 minutes to give carbon fibers of which the tensile strength was 253 kg/mm$^2$.

EXAMPLE 2

The conditions for the two-step heat treatment of the starting pitch material were substantially the same as in Example 1 excepting the reduction of the time for the second step heat treatment to 15 minutes instead of 20 minutes. The thus obtained pitch material was composed also of the optically anisotropic phase alone and had a number average molecular weight of 1080, content of the pyridine-insoluble matter of 42.4% by weight and softening point of 335° C.

The pitch material was then subjected to the process of spinning, infusibilization and calcination to give carbon fibers having a tensile strength of 250 kg/mm$^2$.

EXAMPLE 3

A residual oil of catalytic cracking obtained in a catalytic cracking plant of heavy gas oil was freed from the ash content by filtration and then subjected to distillation under reduced pressure to remove the lighter oily matter and the residual oil left after the distillation was introduced into a mixing vessel and heat-treated there for 1 hour at a temperature of 420° C. under a pressure of 10 mmHg to give a treated pitch of which the content of the toluene-insoluble matter was 35% by weight. The thus obtained pitch material was then introduced continuously into a centrifugal film evaporator equipped with 4 rotating blades in which the pitch material was subjected to a heat treatment at 470° C. under a stream of nitrogen gas at a pressure of 1 mmHg. The staying time of the pitch material was 10 minutes when the blades were rotated at a velocity of 100 r.p.m. with a clearance of 0.5 mm between the vessel wall and the periphery of the blades. The thus obtained pitch material was composed of the meso phase pitch alone and had a content of the pyridine-insoluble matter of 69% by weight, number average molecular weight of 1200 and softening point of 350° C.

The pitch material for carbonaceous bodies obtained in the above described manner was spun at 380° C. into pitch filaments having a diameter of 7 μm and the filaments were infusibilized by heating in air at a temperature of 300° C. for 20 minutes followed by calcination at 1500° C. for 10 minutes in an atmosphere of argon to give carbon fibers having a tensile strength of 290 kg/mm$^2$.

COMPARATIVE EXAMPLE 1

The conditions for the two-step heat treatment of the starting pitch material were substantially the same as in Example 1 excepting the extension of the time for the second step heat treatment to 40 minutes instead of 20 minutes. The thus obtained pitch material was composed also of the optically anisotropic phase alone and had a number average molecular weight of 1200, content of the pyridine-insoluble matter of 75% by weight and softening point of 370° C. Considerable difficulties were encountered in the spinning of this pitch material since the pitch could be spun only when the spinning temperature was 400° C. or higher. The pitch material was processed in the same manner as in Example 1 into carbon fibers which had a tensile strength of 160 kg/mm$^2$. The length of time for the infusibilization treatment of the pitch filaments was 10 minutes in this case.

COMPARATIVE EXAMPLE 2

A residual oil of catalytic cracking obtained in a catalytic cracking plant of heavy gas oil was freed from the ash content by filtration and then subjected to distillation under reduced pressure to remove the lighter oily matter and to leave a residual oil having a boiling point of 420° C. or higher under normal pressure as extrapolated from the actually determined value, which was used as the starting material in the subsequent treatments. Thus, the starting pitch was first subjected to a first step heat treatment at a temperature of 440° C. for 4 hours under normal pressure to give an isotropic pitch containing 75% by weight of the toluene-insoluble matter which was then subjected to a second step heat treatment at a temperature of 460° C. for 30 minutes under a pressure of 10 mmHg to give a treated pitch material, of which the content of the optically anisotropic phase was 85%, having a number average molecular weight of 950, content of the pyridine-insoluble matter of 65% by weight and softening point of 260° C.

In the next place, this treated pitch was processed into carbon fibers in the same manner as in Example 1 including the step of spinning, infusibilization and calcination. The infusibilization treatment took a time of 120 minutes. The spinning was frequently interrupted by the break of the pitch filament under drawing and the finished carbon fibers had a tensile strength of 155 kg/mm$^2$.

What is claimed is:

1. A pitch material for carbonaceous body which is characterized by the parameters of:

(a) a content of the optically anisotropic phase in the range of at least 80%;

(b) a content of the pyridine-insoluble matter in the range from 30 to 70% by weight;

(c) a number average molecular weight in the range from 1000 to 1400; and (d) a softening point in the range from 330° to 380° C.

2. The pitch material for carbonaceous body as claimed in claim 1 composed substantially of the optically anisotropic phase alone and having the parameters of the content of the pyridine-insoluble matter in the range from 40 to 60% by weight, the number average molecular weight in the range from 1000 to 1300 and the softening point in the range from 330° to 370° C.

3. A method for the preparation of a pitch material for carbonaceous body characterized by the parameters of (a) a content of the optically anisotropic phase in the range of at least 80%, (b) a content of the pyridine-insoluble matter in the range from 30 to 70% by weight, (c) a number average molecular weight in the range from 1000 to 1400, and (d) a softening point in the range from 330° to 380° C., which comprises the steps of:

(A) a first step heat treatment of a starting pitch material obtained by removing the light oily matter from a petroleum-based residual oil at a temperature in the range from 400° to 460° C. under a pressure in the range from 5 to 50 mmHg; and (B) a second step heat treatment of the pitch material after the step (A) at a temperature in the range from 450° to 500° C. for a length of time in the range from 0.2 to 30 minutes under a pressure in the range from 0.1 to 5 mmHg.

4. The method for the preparation of a pitch material for carbonaceous material as claimed in claim 3 wherein the second step heat treatment in the step (B) is performed in a film evaporator under an atmosphere of an inert gas or a non-oxidizing gas.

5. The method for the preparation of a pitch material for carbonaceous material as claimed in claim 3 wherein both of the first and the second step heat treatments are performed in a film evaporator under an atmosphere of an inert gas or a non-oxidizing gas.

6. The method for the preparation of a pitch material for carbonacecus body as claimed in claim 3 wherein said petroleum-based residual oil is residual oil from the catalytic cracking of petroleum fractions or residual oils from thermal cracking of naphtha.

7. The method for the preparation of a pitch material for carbonaceous body as claimed in claim 3 wherein said first heat treatment is for a length of time in the range from 0.1 to 20 hours.

8. The pitch material for carbonaceous body as claimed in claim 1 wherein the number average molecular weight is at least 1080.

* * * * *